US006102428A

United States Patent [19]

Bobrowicz

[11] Patent Number: 6,102,428

[45] Date of Patent: Aug. 15, 2000

[54] ASSEMBLY FOR GLIDING ON SNOW

[75] Inventor: Eric Bobrowicz, Monetier les Bains, France

[73] Assignee: Skis Rossignol, S.A., Voiron Cedex, France

[21] Appl. No.: 09/452,555

[22] Filed: Dec. 1, 1999

[30] Foreign Application Priority Data

| | | | |
|---|---|---|---|
| Dec. 4, 1998 | [FR] | France | 98 15500 |
| Feb. 10, 1999 | [FR] | France | 99 01952 |
| Mar. 25, 1999 | [FR] | France | 99 03908 |
| Sep. 17, 1999 | [FR] | France | 99 11903 |

[51] Int. Cl.[7] ..... A63C 5/00

[52] U.S. Cl. ..... 280/607; 280/14.2

[58] Field of Search ..... 280/607, 609, 280/610, 617, 618, 623, 633, 634, 14.2

[56] References Cited

U.S. PATENT DOCUMENTS

| | | | |
|---|---|---|---|
| 5,172,924 | 12/1992 | Barci . | |
| 5,409,244 | 4/1995 | Young . | |
| 5,417,443 | 5/1995 | Blattner et al. . | |
| 5,765,854 | 6/1998 | Moore et al. . | |
| 5,782,482 | 7/1998 | Andras | 280/14.2 |

FOREIGN PATENT DOCUMENTS

| | | | |
|---|---|---|---|
| 0 848 968 A2 | 6/1998 | European Pat. Off. . | |
| 2 583 296 | 12/1986 | France . | |
| 2 645 037 | 10/1990 | France . | |
| 91 13 766 U | 2/1992 | Germany . | |
| 295 16 548 U I | 3/1996 | Germany . | |
| WO89 10167 | 11/1989 | WIPO | 280/14.2 |
| WO 95/19205 | 7/1995 | WIPO . | |
| WO 95/33536 | 12/1995 | WIPO . | |

*Primary Examiner*—Richard M. Camby
*Attorney, Agent, or Firm*—Richard P. Gilly

[57] ABSTRACT

An assembly for gliding on snow, the assembly comprising a snowboard and a binding system for the boots of the user. The snowboard is provided with a large central depression defining two longitudinal lateral spars placed directly on either side of the depression. Anchor points are formed in said two longitudinal lateral spars. Respective intermediate plates for the front foot and for the back foot are fixed in the anchor points. The intermediate plate is provided in its middle zone overlying the depression with means for anchoring and fixing to the corresponding boot.

40 Claims, 11 Drawing Sheets

FIG. 1

ASSEMBLY FOR GLIDING ON SNOW

The present invention relates to an assembly for gliding on snow, comprising a snowboard and a system for receiving the boots of the user.

BACKGROUND OF THE INVENTION

The board for gliding on snow forming the snowboard is used asymmetrically, with the user having neither the body nor the feet directed on the longitudinal axis of the board, but placed at a considerable angle relative thereto. The user's body is placed transversely relative to the board, and either the right foot behind and the left foot in front for people who steer with the right foot ("regular foot") or else the left foot behind and the right foot in front for people who steer with the left foot ("goofy foot"). The spacing between the feet depends on the morphology of the user, and essentially on the size of the user. The toes are directed more or less towards the front of the snowboard, at an orientation which is expressed as an angle measured from the perpendicular to the longitudinal axis of the snowboard. For the back foot, this orientation generally lies in the range about 0 to 45°, and for the front foot in the range 10° to 45°, the position presently most in favor with numerous skilled users being an "intermediate" position:

- back foot: angle of orientation lying in the range 10° to 15°; and
- front foot: angle of orientation lying in the range 30° to 45°.

In any event, the body of the surfer extends transversely relative to the board and its travel direction. Turns are performed either by leaning the body forwards, i.e. towards the toes (commonly referred to as "front-side") or by leaning the body backwards, towards the heels (or "back-side").

Snowboards are nowadays exceptionally popular, particularly with young people, such that snowboarding competitions are now being organized like skiing competitions, with the "speed" factor becoming essential for snowboards that are intended for competition, as is also the capacity of such snowboards to turn with maximum precision.

This enthusiasm for snowboards is also reaching people other than the young, and as a result it is also becoming necessary to provide ladies' snowboards having good qualities of lightness and comfort, and also snowboards for the general public having good comfort without excessively penalizing effectiveness and light weight.

In general, the board for gliding on snow that constitutes a snowboard must be sufficiently stiff, when flexed while flat, to penetrate as little as possible into the snow and thus to glide as fast as possible without being so stiff as to leave traces of its edges in a curve while turning.

It is therefore necessary for the board to be as stiff as possible when flat, and as flexible as possible when tilted, i.e. when it is inclined and resting on an edge.

These two conditions are contradictory, and the art of the makers of boards for gliding on snow for snowboards consists in finding the best compromise between stiffness and flexibility that makes it possible simultaneously to move fast when the board is flat and also to make turns easily and accurately.

An additional problem lies in the fact that the board constituting such a snowboard is relatively wide, it is generally quite heavy, and that is unfortunate.

Another parameter that it is important to control is the lateral stiffness of the board, i.e. the stiffness which is exerted on the snowboard when it is placed flat on a horizontal slab, and then a laterally-directed force is applied to the middle point of the snowboard. To make it possible to obtain good accuracy in path followed, it is important for the snowboard to be very stiff laterally so as to avoid changing the shape of its side, i.e. the curved shape followed by each of its edges.

OBJECTS AND SUMMARY OF THE INVENTION

A first object of the invention is to reconcile all of those needs and in particular to obtain an assembly for gliding on snow that incorporates a snowboard constituted by a board that is lightweight, stiff in flat flexing and in lateral flexing, less stiff in tilted flexing, and nevertheless very lively.

The systems for holding the feet on a board for gliding on snow, such as a snowboard, are known as "bindings". They are fixed on the snowboard by means of orifices made through the central zone of each binding and through the central zone of the snowboard.

The positions of the orifices for securing a binding to the snowboard are now sufficiently widespread to be considered as being standardized in two geometrical configurations:

- the "4×4" configuration which is the most widespread and which comprises two zones (one for each foot) each having eight holes, these holes being spaced apart at 40 millimeters from one another and being distributed in two parallel columns of four holes each. These eight holes are generally drilled and tapped in the snowboard in advance; and
- the triangular configuration known as "3D" from the trademark filed by BURTON, and to be found on snowboards and bindings from that company.

Such present bindings cannot be transferred unchanged onto a snowboard that is unsuitable for receiving tapping in the locations where they are to be fixed because the board is too thin in those locations, in particular a snowboard that has a longitudinal depression in its middle zone. Another object of the present invention is to remedy that drawback.

In addition, it is known that a snowboard is stiffened in the transverse direction both by the bindings and by the feet of the user, both of which extend across the board. Another object of the invention is to decouple the effect of the user's feet on the transverse stiffness of the snowboard, and more generally to avoid applying constraints to the snowboard in the transverse direction.

Another object of the invention is also to enable various adjustments to be made concerning the positions of the user's feet relative to the snowboard, in particular angular position, longitudinal position, or spacing between the feet.

Another object of the invention is to also to provide beneficial damping of vibration.

One of the present binding systems for a snowboarder's boots is of the "shell" or "soft" type which has the advantage of being capable of receiving boots that are sufficiently flexible to enable the snowboarder to use them also as walking boots that are much more comfortable than conventional ski boots or snowboard boots having rigid soles.

For example, snowboard boots can be practically as comfortable to wear as snow boots.

These soft type bindings comprise, in addition to a plate for receiving the sole of the boot, a hinged heel rest which rises over the back of the Achilles tendon to about ankle level, and two boot-retaining straps, one of which is tightened around the instep and the other around the front of the foot, roughly where the toes begin.

Such soft type bindings are unsuitable for being fitted unchanged to a snowboard which is unsuitable for receiving an anchoring point at the location where the bindings are to be placed because of insufficient thickness at said location, particularly on a snowboard that has a middle longitudinal depression. Another object of the present invention is to remedy that drawback.

Another object of the invention is also to make it possible with such soft type bindings, to obtain adjustable angular position, and positions for the feet of the user relative to the snowboard.

With soft type bindings, the rigid plate which receives the sole of the boot is fixed to the snowboard in a substantially transverse position. This has the drawback of stiffening the snowboard in the transverse direction, and thus of constraining it in transverse flexing, which is most awkward since a snowboard is specifically designed by its manufacturer to have well-defined properties both in longitudinal flexing or "simple" flexing, and in transverse flexing, i.e. flexing in the direction orthogonal to the axis of the snowboard.

Another object of the invention is specially to remedy that drawback, with a snowboard that has a middle longitudinal depression.

Another object of the invention, compared with presently known soft type bindings, is to improve transmission of forces from both ends of the foot, i.e. the toes and the heel, to the snowboard. With present bindings, the stiffness of the single baseplate and the way said plate is fixed relatively close to the middle longitudinal axis of the snowboard, penalize such transmission of forces from the two ends of the foot.

Another object of the invention is to provide better holding of the two ends, front and back, of the boot compared with conventional "soft" type bindings and on a snowboard having a middle longitudinal depression, thereby preventing these two ends from lifting off the surface of the snowboard when gliding on snow.

The invention thus provides an assembly for gliding on snow, the assembly comprising a snowboard and a system for receiving the boots of a user, the snowboard comprising in its longitudinal direction a back zone, a middle zone, and a front zone, and its structure comprising, from the bottom upwards:

- a gliding surface made up of a glide soleplate between metal edges;
- one or more bottom reinforcing layers;
- a core;
- one or more top reinforcing layers; and
- a protective and decoration-carrying sheet made either as a shell and thus constituting the top and the sides of the board, or else existing solely on the top surface of the board, in which case it rests on protective elements running along the sides of the core and referred to as flanks;

wherein:

- the top face of the snowboard presents a substantial middle longitudinal depression which extends over at least the two zones in which the bindings for the feet are positioned, respectively for the front foot and for the back foot of the user, thereby defining on either side thereof two longitudinal lateral spars;
- anchor points are provided in said two longitudinal lateral spars; and
- an intermediate device which is received in said anchor points serves to hold the user's feet to the board.

The invention also provides an assembly for gliding on snow as defined above, wherein its device for receiving bindings includes, between the top surface of the snowboard and the binding, an interface which is constituted by at least one rigid plate which comprises:

- firstly towards the front and back margins which are to cover the right and left lateral portions of the snowboard in said binding-positioning zone, anchor means for anchoring said plate in said right and left lateral portions of the snowboard, said means for anchoring to the snowboard thus being located respectively at the front and at the back of the foot of the user; and
- secondly, in its central zone that is therefore designed to overlie the middle zone of the snowboard, binding receiving and anchoring means provided to coincide with the orifices that exist for this purpose in said binding, said binding anchoring means thus underlying the arch of the sole of the user's foot.

The invention also provides an assembly for gliding on snow of the first above-defined type, in which the device for binding the boots comprises at least, for each foot respectively: a distinct baseplate for receiving the sole of the boot, and wherein said plate for receiving the sole of the boot is fitted with at least two families of orifices or slots to enable said plate to be anchored on the snowboard:

- at the back of the plate: at least one slot or series of at least two holes situated under the back of the boot that is to be received and thus under the heel of the user; and
- at the front the plate: a series of at least two elongate and rectilinear slots situated under the front of the boot to be received and thus under the front of the user's foot, each being oriented towards the central region of the plate, the slots being dimensioned so that in the event of the snowboard flexing, they allow front anchor members for anchoring said baseplate to the snowboard to slide freely therein.

The invention also provides an assembly for gliding on snow of the first above-defined type, comprising for each foot: a respective "soft" type binding suitable for receiving a flexible boot for snowboarding, said binding having lateral margins and a back margin that are raised so as to hold the flexible boot, and at least two straps for holding said flexible boot, comprising a back strap which is tightened over the instep and a front strap which is tightened over the front of the foot,

- wherein said binding has two distinct portions that are separate from each other, namely a front portion which is fixed to the snowboard on its front side and which receives said front strap, and a back portion that is thus independent of the front portion and that is fixed to the heel or back side of the snowboard, and which receives the back strap.

BRIEF DESCRIPTION OF THE DRAWINGS

The invention will be well understood and its advantages and characteristics will appear more clearly on reading the following description of various non-limiting embodiments, given with reference to the accompanying diagrammatic drawings, in which.

MORE DETAILED DESCRIPTION

Figure 1:
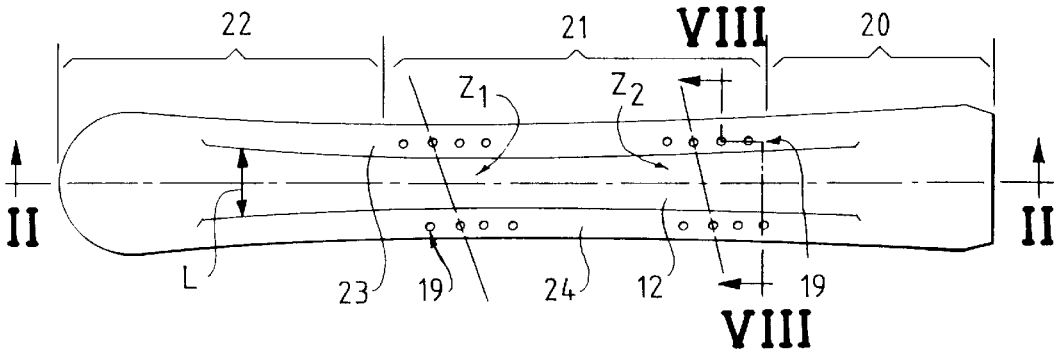
FIG. 1 is a plan view of a first embodiment of a snowboard suitable for forming part of an assembly for gliding on snow in accordance with the invention.
Figure 2:
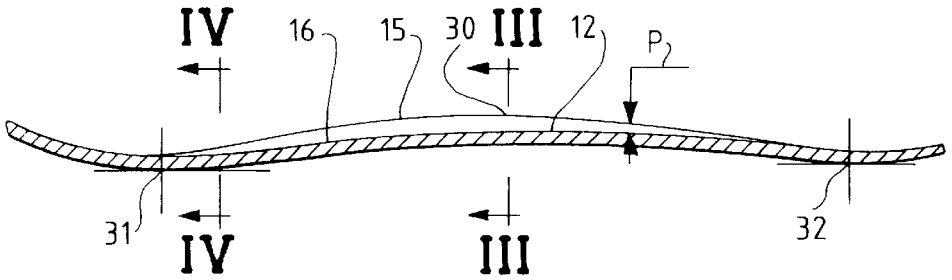
FIG. 2 is a simplified longitudinal section view on II—II of FIG. 1.

With reference initially to the assembly of FIGS. 1 to 4, there is shown a snowboard for forming part of an assembly of the invention for gliding on snow and comprising, in the longitudinal direction, a back zone 20, a middle zone 21, and a front zone 22, and having the structure of the type that is known as "rectangular", comprising:

- a gliding surface constituted by a glide soleplate 1 between lateral metal edges 2 and 3;
- rigid lateral flanks 4 and 5;
- a bottom reinforcing layer 6 made of fibrous material;
- a top layer 7 for protection and decoration, forming the top surface of the board, made of a flexible plastics material adjacent on its inside to a top reinforcing layer 8, also made of fibrous material; and
- a polyurethane core which, in accordance with the present invention, is made up of three distinct longitudinal bars, a central and axial bar 9 and two lateral bars 10 and 11 disposed on either side of the middle bar 9, thereby forming two lateral and longitudinally-extending spars.

Furthermore:

- the top surface of the snowboard has a substantial middle longitudinal depression 12 which in this case extends over a length covering the middle zone 21 of the snowboard, including the two zones Z1 and Z2 on which the feet are positioned (the front foot and the back foot respectively of the user), and extending in this non-limiting example substantially over the load carrying length of the snowboard, i.e. substantially between its front contact line 31 and a line situated close to the back contract line 32. The depth P and the width L of the axial groove 12 are considerable. In this embodiment this depth varies along the snowboard depending on the position under consideration, the bottom 16 of the groove 12 in this case approximately following the shape of the bottom surface of the snowboard, while the width L also varies in this case along the snowboard, as shown in FIG. 1, lying between one-fifth and three-fifths of the width of the board. This depth P is determined in this case by the thickness of the residual material in the middle zone 21. In the present case, the thickness of the residual material is substantially equal to the thickness of the snowboard at its leading end and its trailing end. In an advantageous aspect of the invention, the depth P of the groove 12 makes it possible to adjust the distribution of stiffness over the snowboard at will so as to obtain a snowboard having any desired particular characteristics;
- each of the right and left lateral bars 11 and 10 is sheathed in a box structure by a respective casing 14, 13 of fibrous reinforcement material, e.g. the same material as is used for the bottom and top reinforcement 6 and 8, thereby forming respective lateral spars 23 and 24 of box structure, said two box spars 23 and 24 being placed respectively almost immediately on either side of said depression or groove 12; and
- the anchor points 19 for the binding devices for boots are formed in the two box spars 23 and 24. These anchor points are provided either by inserts 17 and 18, optionally pre-drilled inserts, received in each of the box spars 10, 11, or by additional mechanical reinforcement to guarantee that binding-securing screws present good resistance to being torn out. They can also be obtained quite simply, when installing the binding, by drilling the box spars 10 and 11.

Figure 3:
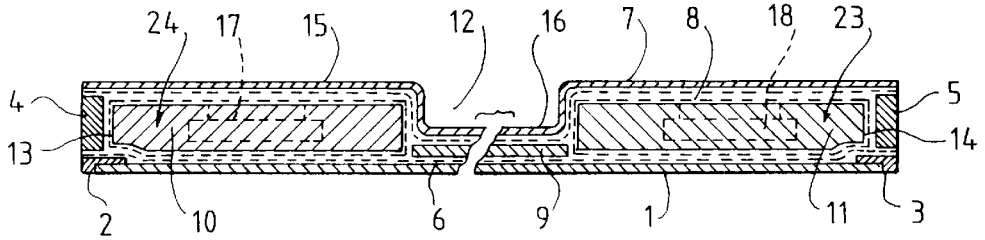
FIG. 3 is a cross-section on III—III of FIG. 2.
Figure 4:
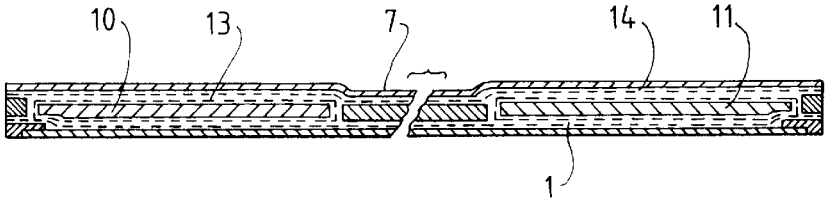
FIG. 4 is a cross-section on IV—IV of FIG. 2.

In the example shown in FIGS. 3 and 4, each of the lateral beams 10 and 11 is of rectangular section. The central bar 9 which is positioned under the depression 12 is of very flat rectangular section, as can be seen in FIG. 3.

Each of the lateral spars 23 and 24 is thus placed almost immediately on a respective side of the central depression 12.

It should be observed that in this embodiment, the bottom portions of the two fiber sheaths 13 and 14 are superposed on the bottom reinforcing layer 6. Similarly, the top reinforcing layer 8 fits closely to a large extent over the lateral and top walls of the two sheaths 13 and 14.

Figure 5:
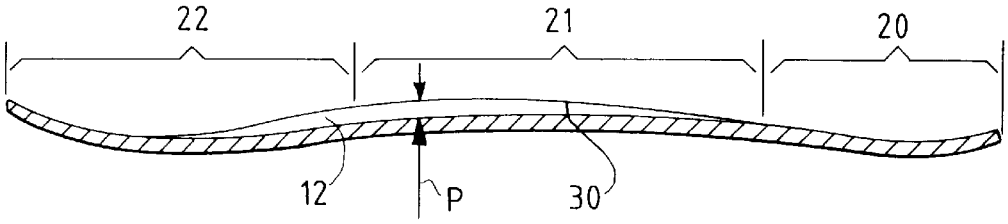
FIG. 5 is a view similar to FIG. 1, showing a first variant embodiment.

In the variant of FIG. 5, the groove 12 is deeper at the front of the snowboard than it is at the back thereof. This provides a snowboard which is more flexible in its front portion than it is in its back portion. This embodiment provides a snowboard that is easier to enter into a turn while nevertheless behaving well while turning since its stiffer back portion is less inclined to slip.

Figure 6:
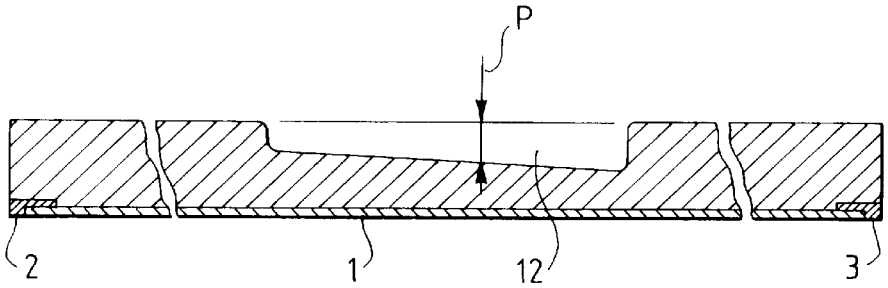
FIG. 6 is a view similar to FIG. 3, although somewhat simplified, showing a second variant embodiment.

In the variant of FIG. 6, the depth P of the groove 12 varies continuously in a transverse plane, so that it is deeper on one side than on the other, and in this case on the right-hand side. This has the beneficial effect of making one side harder than the other: in the example shown here the left-hand side is stiffer than the right-hand side.

In analogous manner, local adjustment of stiffness can be obtained by varying the width L of the groove 12, at least over a portion of its length.

Figure 7:
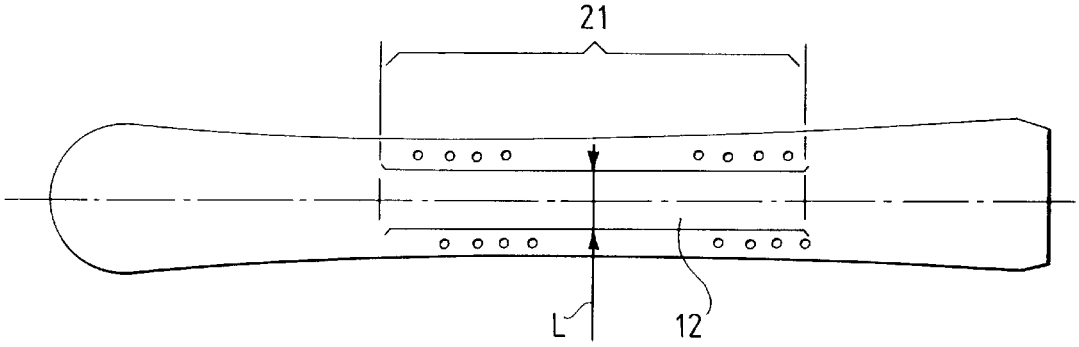
FIG. 7 is a view similar to FIG. 1, showing a third variant embodiment.

In the variant of FIG. 7, the groove 12 is of practically the same length as the middle zone 21 of the snowboard. In addition, to illustrate the non-limiting character of the invention, its width L is constant. Similarly, its depth P can also be constant, thereby making it much easier to machine. Naturally, constant depth P and/or width L can be applied to other possible embodiments.

Figure 8:
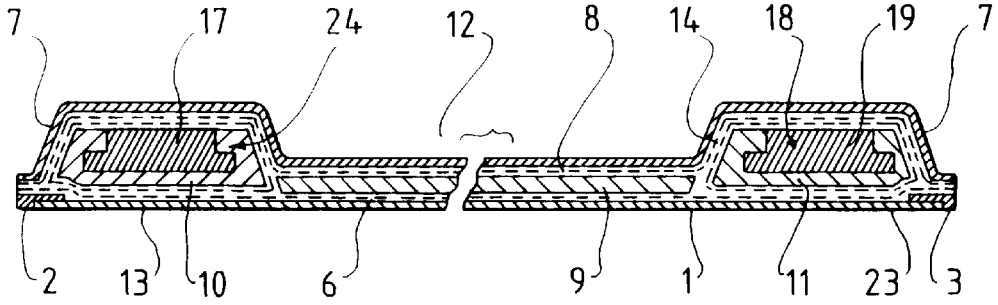
FIG. 8 is a section view on VIII—VIII of FIG. 1 and shows a fourth embodiment.

The variant of FIG. 8 shows an embodiment of a snowboard of the "shell" type, i.e. a snowboard whose top protective and decorative layer 7 also constitutes the lateral faces of the snowboard. This snowboard has metal inserts 17 and 18 embedded in polyurethane and constituting the anchor points for the bindings for holding the user's boots.

In this embodiment, it should be observed that each of the two lateral spars 23 and 24 is substantially trapezoidal in section.

Figure 9:
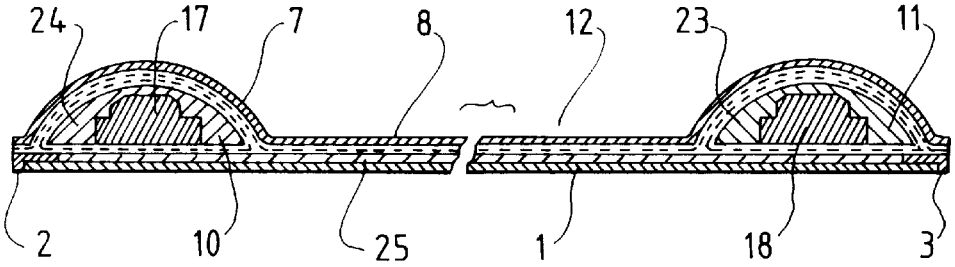
FIG. 9 is a view similar to FIG. 8, and shows a fifth embodiment.

FIG. 9 shows another variant embodiment of a snowboard for an assembly of the invention for gliding on snow, but which presents the following special features:

- it does not have a central core 9, but in contrast it does have a bottom reinforcing plate 25 overlying the sole-plate 1 and constituted by a metal plate, typically made of aluminum alloy, situated between the flanges of the edges 2 and 3 and in line with the flanges. In this embodiment, the top fiber reinforcement 8 covers the lateral and top portions of the box spars 24 and 23. It also covers the metal plate 25 in the central portion of the snowboard, as shown;
- each of its lateral spars 23 and 24 is rounded or semicircular in section instead of being trapezoidal as in the embodiment of FIG. 8; and
- the two cores 10 and 11 of the spars 24 and 23 are made of wood, and the above-mentioned metal inserts 17 and 18 are fitted in the cores 10 and 11 after they have been appropriately machined.

Naturally, the structure of a snowboard for a gliding assembly of the invention is not limited to the embodiments described above. Thus, in various embodiments, the depth P of the depression or groove 12:

- is constant over the length of the board depending on the position thereof that is taken into consideration, the bottom 16 of the depression 12 approximately following the shape of the top surface 16 of the board;
- varies along the length of the board depending on the position thereof that is taken into consideration, with this variation in depth being different towards the front and towards the back of the board;
- varies along the length of the board depending on the position thereof taken into consideration, with this variation in depth being substantially identical towards the front and towards the back of the board, so that the board is substantially symmetrical (FIG. 2) about a high middle point thereof (30, FIGS. 2 and 5);
- varies across the width of the board so as to be greater on one side than on the other (FIG. 6); and
- varies along the length of the board depending on the position therein that is taken into consideration, with this variation in depth differing towards the front and towards the back of the board so as to be asymmetrical about the highest middle point 30 of the board.

Thus, the bottom 16 of the groove 12 can be plane or non-plane in shape, e.g. convex or concave . . . , while the width L of the groove can either be constant or can vary along the length of the groove.

Figure 10:
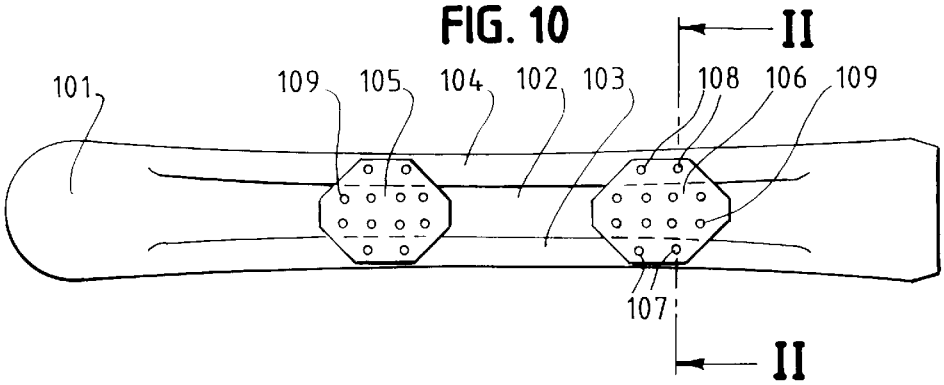
FIG. 10 is a plan view of a snowboard fitted with a device for receiving bindings in accordance with the invention.
Figure 11:
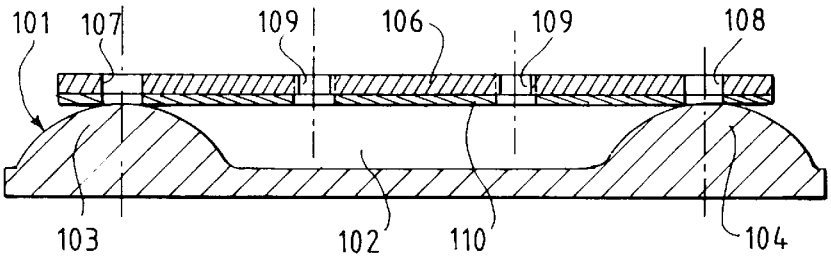
FIG. 11 is a cross-section on II—II of FIG. 10.

With reference now to FIGS. 10 and 11, there is shown a snowboard 101 which, as described above, has a longitudinal and axial depression 102 which defines two longitudinal spars or ribs 103 and 104 on either side thereof.

Since the top surface of the snowboard is not plane, and in addition since the snowboard cannot have binding anchor points in its central zone because it is so thin therein, a conventional binding cannot be used with this kind of snowboard.

For this kind of snowboard, the invention provides using an intermediate interface device for placing between the snowboard and the binding in question, the interface device being constituted by a rigid plate, respectively 105 for the front binding and 106 for the back binding.

Each rigid plate 105 or 106 has means anchoring it in each of the lateral margins 103 and 104 of the board. In this case, the anchor means are constituted by two orifices 107 through which respective screws can pass to be anchored in the margin 103, and two other orifices 108 through respective screws can pass to be anchored in the other margin 104.

In addition, and this is an important advantage, in order to be able to use bindings of the kind that are readily available on the market, each rigid plate 105 and 106 has in its central zone that locally overlies the depression 102 a set of eight tapped holes which are in positions that correspond with the orifices that are conventionally to be found in commercially-available bindings. The front and back bindings are thus respectively received in the front intermediate plate 105 and the back intermediate plate 106 by means of these tapped holes 109.

At this point, it should be observed that although not absolutely essential for implementing the invention, the intermediate plates 105 and 106 are fitted to the snowboard 101 via respective plates 110 of material presenting damping characteristics, e.g. plates 110 of viscoelastic material, thereby making the snowboard more comfortable.

The rigid plates 105 and 106 are advantageously made of light metal, e.g. of ribbed steel or of aluminum alloy. They also be constituted by a rigid plastics material or by a material made using glass fibers or carbon fibers.

Figure 12:
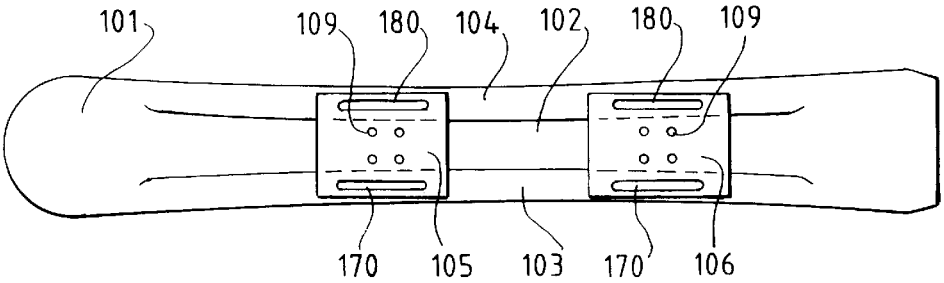
FIGS. 12, 13, 14, 16, and 17 are views similar to FIG. 10 showing other embodiments.

FIG. 12 shows a variant embodiment in which the pairs of orifices 107, 108 are replaced by respective longitudinal slots 170 and 180, thereby making it possible to adjust the longitudinal positions of the intermediate plates 105 and 106.

In this case there is no need to provide eight tapped holes, since spacing can be adjusted by means of the slots 170 and 180.

Figure 13:
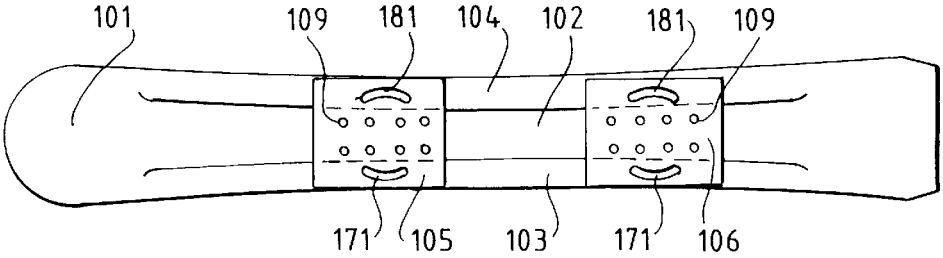

FIG. 13 shows a variant embodiment in which the pairs of orifices 107 and 108 are replaced by respective circularly-arcuate slots 171 and 181, thereby enabling the positions of the intermediate plates 105 and 106 to be adjusted angularly.

Figure 14:
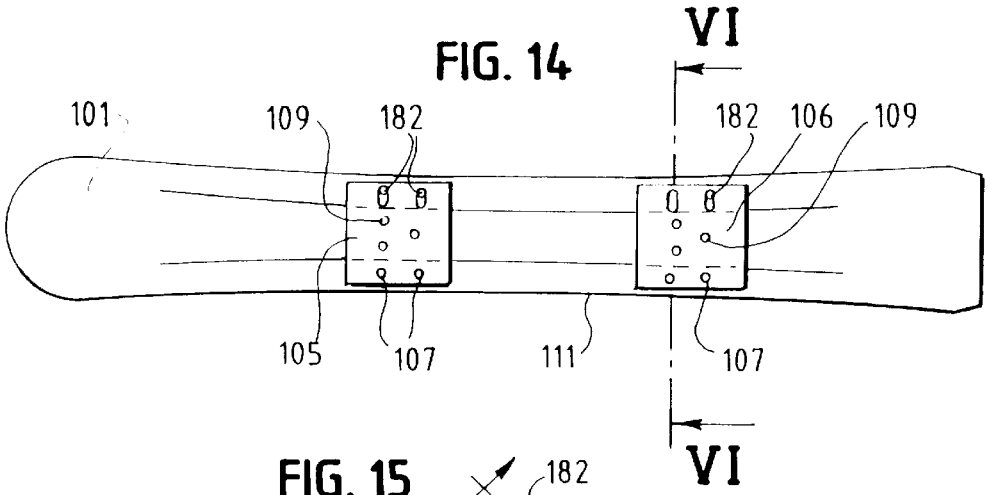
Figure 15:
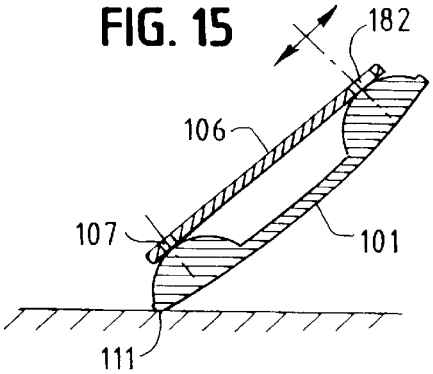
FIG. 15 is a cross-section view on VI—VI of FIG. 14 showing how the snowboard deforms and the position it takes up relative to one of the two plates for receiving bindings when the snowboard is steeply inclined on an edge, as typically occurs while turning.

FIG. 14 shows a variant embodiment in which both orifices 108 at the toe end are replaced by respective transverse slots 182 making it possible to avoid opposing transverse deformation of the snowboard into a circular arc, as shown in FIG. 15 where the snowboard 101 is tilted onto its edge 111 adjacent to the heels of the user, as occurs typically while turning. Under such circumstances, the screws anchoring the plates 105 and 106 near the toes of the user are screws that are tightened so as to allow them to slide in the respective slots. By way of example, they can be stepped screws.

It should be observed that to illustrate the non-limiting nature of the invention, the orifices 109 for receiving the bindings are, in this case, disposed in a triangular configuration, which likewise corresponds to a standard configuration for bindings of the kind that are commercially available.

Figure 16:
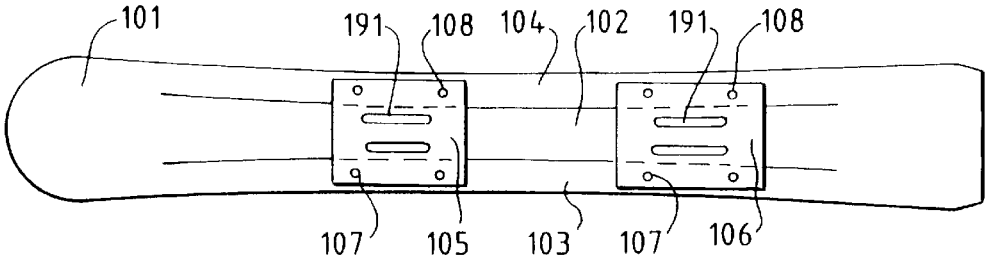

The combination in accordance with the invention of a snowboard having a longitudinal depression 102 and intermediate plates 105 and 106 makes it possible, as shown in FIG. 16, to use longitudinal slots 191 replacing the tapped holes 109 for receiving bindings in the depressed zone 102 situated between the rib-forming margins 103 and 104 of the snowboard. Under such circumstances, it suffices to replace the anchoring screws of the bindings with screw-and-nut systems capable of sliding in the slots 191, prior to being tightened, thereby making it very simple to adjust the longitudinal positions of the bindings on the snowboard 101 without having to alter the positions of the intermediate plates 105 and 106.

Figure 17:
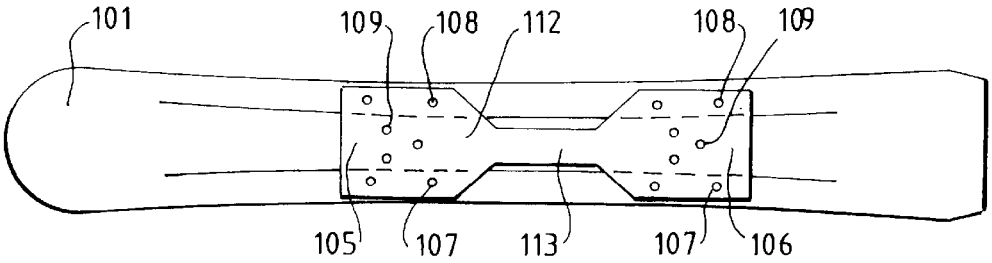

FIG. 17 shows a variant embodiment in which the two intermediate plates 105 and 106 are replaced by a single intermediate plate 112 of sufficient length to receive both the front binding and the back binding, and consequently provided with orifices 107, 108, and 109, both in a front portion 105 and in a back portion 106.

It should be observed at this point that the front and back portions 105 and 106 of the single plate 112 are united by a narrower portion 113, thereby saving weight and material.

Figure 18:
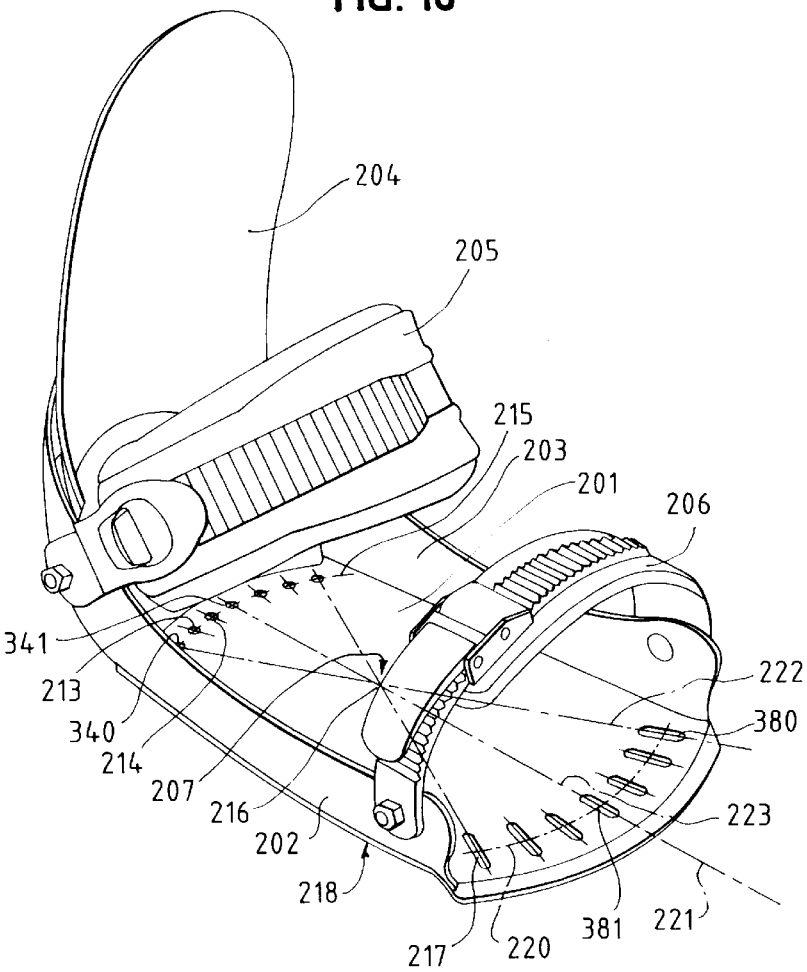
FIG. 18 is an overall perspective view of a soft type binding, in particular for the snowboard of FIGS. 1 to 9.

With reference now to FIG. 18, there is shown a "soft" type binding for a snowboard having a middle longitudinal depression, and for example a snowboard of the kind shown in FIGS. 1 to 9.

This binding conventionally comprises a plate 201 for receiving the sole of a boot, raised lateral margins 202 and 203, a hinged back rest 204 which rises over the back of the Achilles' tendon to about ankle level, and two boot-retaining straps, comprising a back strap 205 for tightening around the instep and a front strap 206 for tightening around the front of the foot roughly where the toes begin, these two straps 205 and 206 being fixed and hinged onto the lateral rims 202 and 203 of the foot-receiving plate 201.

For prior art bindings, they are secured to the snowboard via orifices which are formed in the central zone 207 of their plates 201 for receiving the sole of a boot. That makes them unsuitable for fitting to a snowboard of the kind shown in FIG. 19 which has a longitudinal depression 208 defining on either side thereof respective longitudinal and lateral spars 209 and 210.

This does not apply to the binding shown in FIG. 18.

This binding is designed to be secured in regions 209 and 210 close to the longitudinal lateral margins 211 and 212 (FIG. 19) of the snowboard to which they are fitted. To this end, they comprise (FIG. 18):

towards the back of the plate 201, a series 213 of securing holes 214 which are disposed on a circular arc 215 about a center 216 which is situated approximately in the central portion 207 of the plate 201, as can be seen in the drawing, i.e. under the sole of the user's foot. This series 213 of holes 214 is positioned towards the back of the boot that is to be received, i.e. substantially beneath the user's heel; and at the front of the plate 201, a series of elongate and rectilinear securing slots 217 which are positioned at the front of the boot to be received and thus approximately beneath the toes of the user, with the longitudinal axes 221 of the slots 217 converging on a point 216 positioned in the central zone 207 of the plate 201, the centers of the slots 217 being situated on a circular arc 220 centered on 216.

Figure 19:
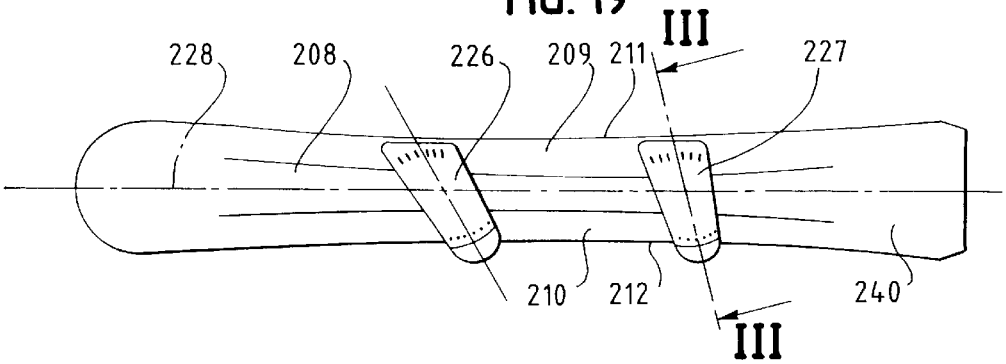
FIG. 19 is a plan view of a snowboard fitted with the FIG. 18 binding.

As can be seen in FIG. 19, this type of binding is easy to mount on a snowboard 240 having a central longitudinal depression 208.

By securing the binding via at least one conjugate "back hole-front slot" pair 340 & 380 and 341 & 381, i.e. a pair lying on a common diameter 222 or 223, it is possible to adjust the angular orientation of the front binding 226 and of the back binding 227 relative to the middle longitudinal axis 228 of the snowboard 240.

Advantageously, it should be observed that a layer 218 of viscoelastic material is fitted beneath the baseplate 201.

Figure 20:
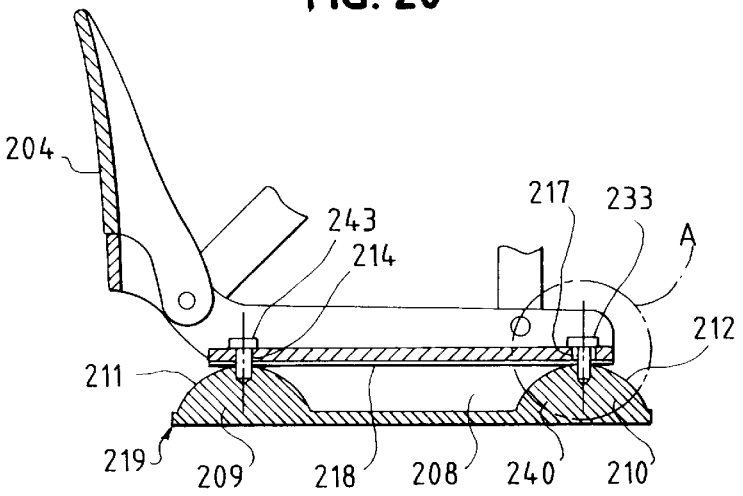
FIG. 20 is a fragmentary section on III—III of FIG. 19.
Figure 21:
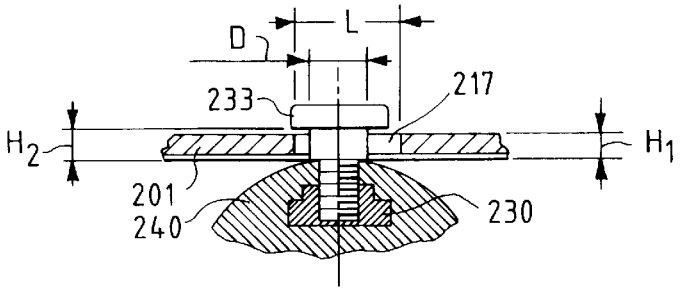
FIG. 21 is detail "A" of FIG. 20.
Figure 22:
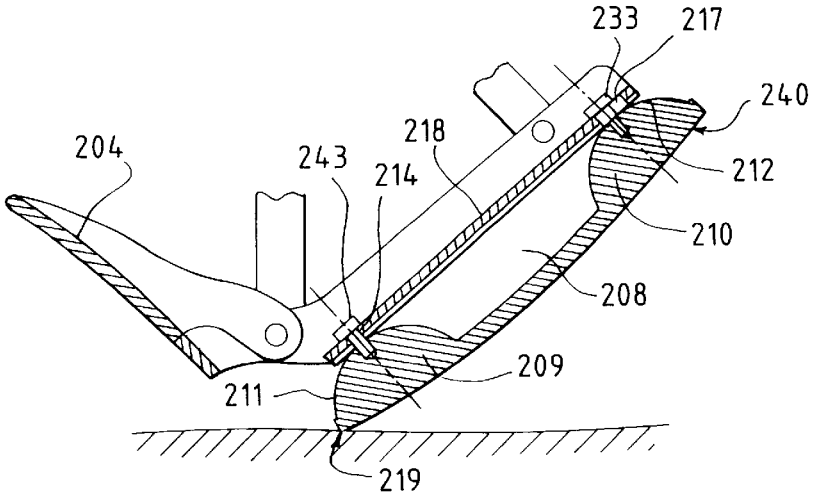
FIG. 22 is a view similar to FIG. 20, with the snowboard being steeply inclined on an edge as occurs typically while turning.

FIGS. 20, 21, and 22 serve to explain how the front slots 217 make it easy for the snowboard 240 to flex transversely when heavy pressure is applied to its back edge 219 by allowing conventional stepped screws securing the front of the baseplate to slide in the slots, thereby enabling the action of the user's feet to be decoupled from the transverse stiffness of the snowboard, and more generally thereby avoiding applying constraints to the snowboard in the transverse direction.

The back securing screws 243 which pass through the holes 214 are ordinary screws for maintaining two parts in relative disposition. In contrast, the front securing screws 223 are stepped screws which simultaneously hold each binding down onto the top of the snowboard while nevertheless allowing sliding to take place along the axis of the selected front slot(s) 217.

Consequently, the length L of the slots 217 is greater than the width D of the step of a screw 233 (i.e. the enlarged portion of the screw lying beneath its head). In addition, the thickness H1 of the plate 201 must naturally be less than the height H2 of the step on the screw 233 (see FIG. 21). It should be observed that as shown in FIG. 21, the screw 233 is conventionally received in a metal insert 230 which is embedded in the body of the snowboard 240.

As mentioned, FIG. 22 shows clearly how the snowboard 223 can flex transversely, and shows how the stepped screws at the front 223 then slide in the slots 217 so that the binding does not counter this flexing movement of the snowboard.

Figure 23:
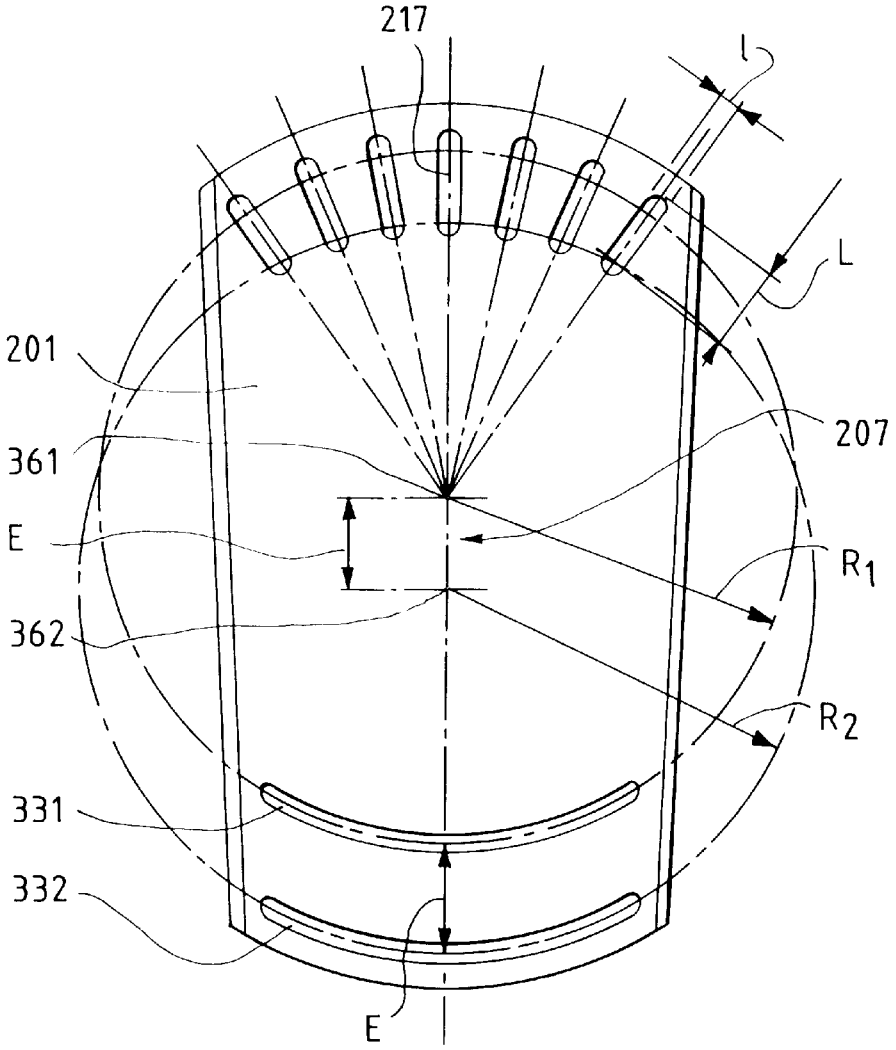
FIG. 23 is a diagrammatic plan view for this binding, showing its plate for receiving the sole of the boot, in a variant embodiment.

FIG. 23 shows a variant embodiment and shows in particular:

that the series 213 of back holes 214 can be replaced by a circularly-arcuate slot 331 or 332;

that it is possible to adjust the transverse position of the binding on the snowboard by providing not only one but a plurality of back slots, in this case two back slots 331 and 332. The slot 331 of radius R1 has a center 361 situated in the central zone of the plate 201, while the slot 332 of radius R2 has a center 362 that is offset from the center 361 of the slot 331 by an offset E, as can be seen in the drawing. Under such circumstances, when adjusting the transverse position of the plate 201 relative to the snowboard, one or other of the slots 331 and 332 is selected for securing the binding. Under such circumstances, it should be observed that the offset E must be less than the length L of the front slots 217; and that to enable the stepped screw 233 to slide transversely in the slot 217 in spite of the offset E, it is necessary to have clearance corresponding to a considerable difference between the diameter D of the stepped portion of the screw 233 and the width l of the slot 217.

Naturally, the invention applies not only to a "soft" type binding, but also to any type of binding which possesses a respective distinct baseplate for each foot, such as the plate 201, that is designed to receive the sole of the user's boot.

In the variant of FIG. 23, it is clear that one and/or both back slots 331 and 332 could be replaced by a series of back holes as in the embodiment of FIG. 20.

Figure 24:
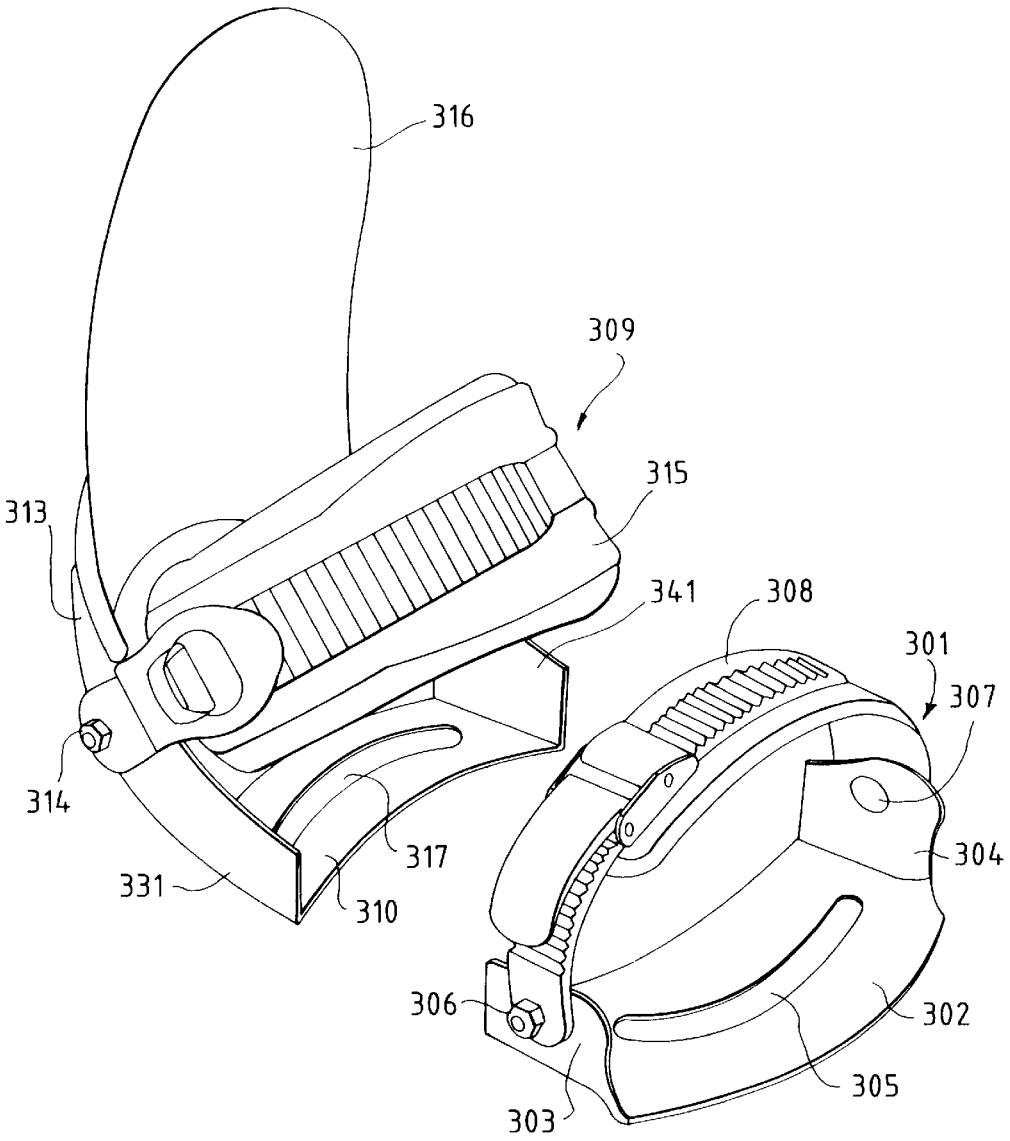
FIG. 24 is a perspective view of another soft type binding, in particular for the snowboard of FIGS. 1 to 9.

With reference now to FIG. 24, there can be seen another "soft" type binding for snowboards having a middle longitudinal depression, with each binding being constituted in this case by two distinct portions:

a front portion 301 for receiving the front portion of the flexible boot and having a rigid metal baseplate 302 with raised lateral margins 303 and 304, said rigid plate 302 having a circularly-arcuate transverse slot 305 whose concave side faces towards the location of the sole of the foot, said slot being designed to receive anchor means for securing the front portion 301 on the snowboard. The raised margins 303 and 304 of the plate 302 receive in conventional manner by means of respective fixing nuts and hinged 306 and 307 the ends of a strap 308 for holding the front of the boot, which strap is conventionally tightened around the front of the foot, roughly where the toes begin; and a back portion 309 for receiving the back portion of the flexible boot and comprising a rigid metal baseplate 310 with raised lateral margins 331 and 341 that are connected to each other by a curved back strip 313 serving as a rest for the Achilles' tendon. In conventional manner, the lateral margins 331 and 341 carry respective nuts 314 on which there are hinged both a back strap 315 which is tightened around the instep, and a back rest or spoiler 316 which covers the back of the Achilles' tendon and rises to about ankle level. The rigid baseplate 310 has a circularly-arcuate transverse slot 317 whose concave side is directed towards the location of the sole of the foot, said slot being designed to receive means for anchoring said back portion 309 to the snowboard.

Figure 25:
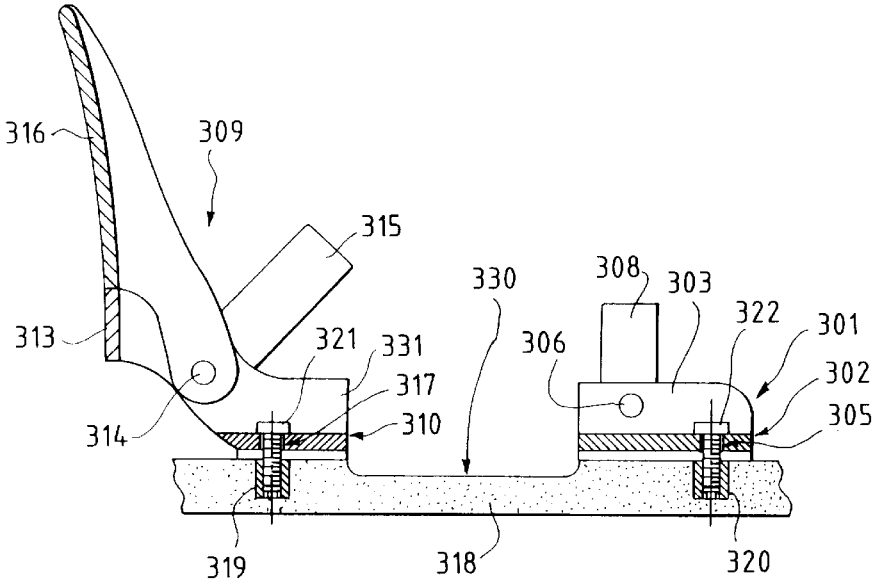
FIG. 25 is a longitudinal section of the FIG. 24 binding once installed on and bolted to a snowboard.

FIG. 25 shows this binding 301, 309 in position on the snowboard 318. In conventional manner, the snowboard has tapped tubular metal inserts 319 and 320 in which the anchor screws 321 and 322 are securely engaged after passing through the slots 317 and 305.

This snowboard 318 is naturally like those described above, and has a middle longitudinal depression 330 which extends substantially over the entire load-carrying length Lp of the board.

Figure 26:
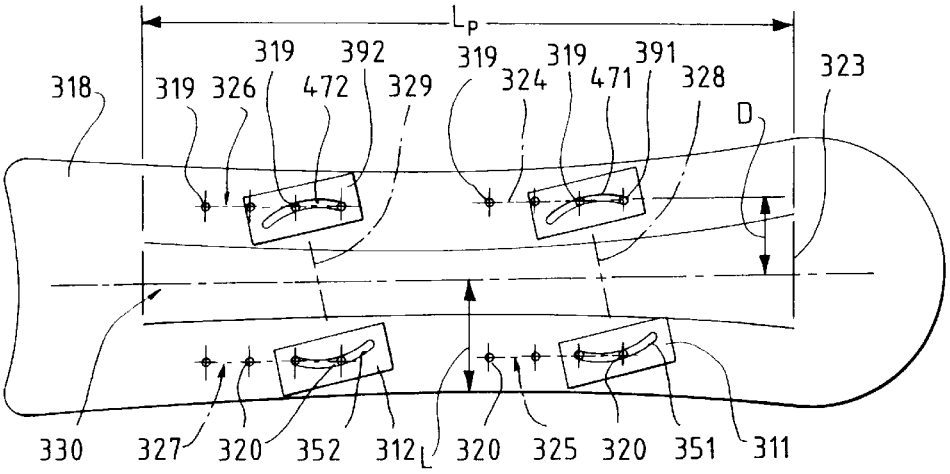
FIG. 26 is a highly simplified plan view of the FIG. 25 snowboard showing both bindings, front and back, adjusted to occupy a proper position.

In FIG. 26, the front and back bindings 391 & 311 and 392 & 312 are shown in position on the snowboard 318. The front portions 311 and 312 of these two bindings and the back portions 391 and 392 thereof are represented diagrammatically by rectangles to avoid overcrowding the drawing.

On either side of its middle longitudinal axis 323, the snowboard 318 comprises in symmetrical manner:

At the front: two rows 324, 325 each comprising four inserts 319, 320 that are regularly spaced apart. The two rows 324 and 325 are parallel to the axis 323, symmetrical to each other about said axis, and spaced apart from the axis by a distance D which is greater than half the minimum width L of the snowboard 318 in the middle longitudinal zone thereof. In this embodiment, the distance D is substantially equal to two-thirds of the half-width L.

At the back: two other rows 326 and 327 each having four inserts 319 and 320, these two rows being dimensioned and positioned in the same manner as the two front rows 324 and 325, but being situated behind them.

Each circularly-arcuate slot, front slots 315 and 352 for the front binding and the back binding respectively, and back slots 471 and 472 for the front binding and the back binding respectively, receives two fixing screws and is therefore associated with two respective inserts (two inserts 320 for each front portion 311 and 312, and two inserts 319 for each back portion 391 and 392).

Figure 27:
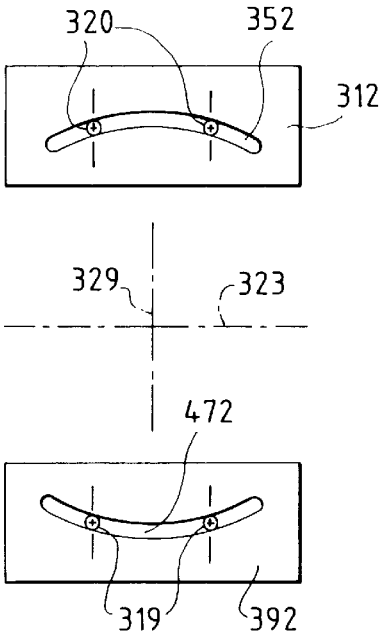
FIGS. 27 and 28 show two positions for angular adjustment of the binding.
Figure 28:
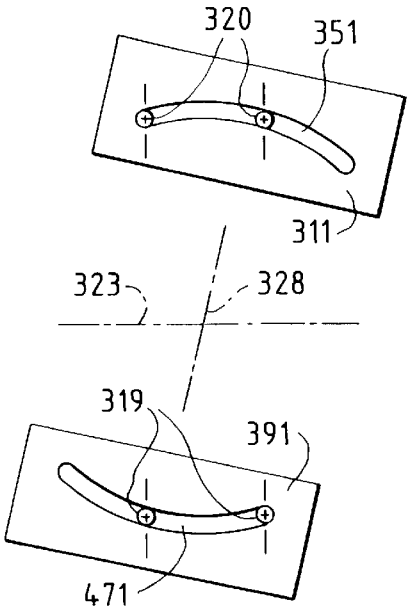

Since all of the slots are circularly arcuate, it can be seen, likewise with reference to FIGS. 27 and 28, that before the anchor screws are tightened, it is possible to adjust the angle at which the respective axis 328 or 329 of each front or back binding is adjusted relative to the longitudinal axis 323 of the snowboard: for this purpose, it suffices to turn the front portions 311 and 312, and the back portions 391 and 392, with such turning being made possible and being guided by the slots 351 & 352 and 471 & 472.

To adjust the longitudinal spacing or "stance" between the front binding 311, 391 and the back binding 312, 392, it suffices to select pairs of inserts 319 from the four inserts in each row accordingly, which is entirely conventional with other binding systems.

Figure 29:
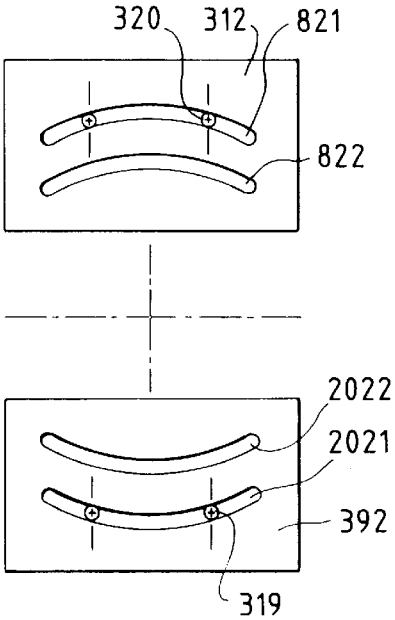
FIGS. 29 and 30 are diagrams of a variant of the binding, showing two length adjustment positions, since this variant makes this adjustment possible.

FIG. 29 which should be compared with FIG. 27 is a diagram of a variant embodiment of this binding.

In this variant, each front portion 312 and each back portion 392 of the binding is provided with two circularly-arcuate slots respectively 821 & 822 and 2021 & 2022, instead of only one.

On each front or back portion 312, 392 of the binding, the two circular arcs formed by the slots are parallel, or in other words the two arcs share a common center.

Figure 30:
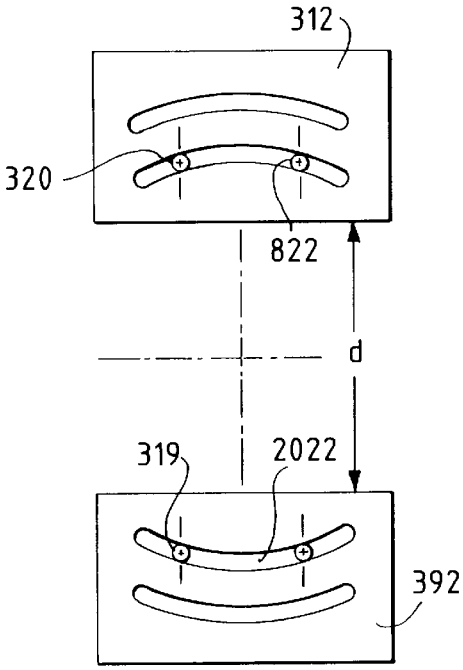

As can be seen in FIG. 30, this disposition makes it possible to vary the distance between the front portion 312 and the back portion 392 of the binding as a function of the user's shoe size: this can be done merely by using one or other of the two slots when anchoring each of the two portions 312 and 392 on the snowboard.

In the example of FIG. 30, two inner slots 822 and 2022 have been selected for anchoring in the inserts 319 and 320, thereby giving the maximum spacing d between the front portion 312 and the back portion 392 of the binding.

Naturally, the invention is not limited to these two embodiments.

Thus, for example, one of the front or back portions 301 or 309 of the binding could be fitted with one or more orifices for receiving a single fixing screw. The angular adjustment of the binding would then take place by rotating said portion about its single screw, while the other portion of the binding is fitted as before with one or more circularly-arcuate slots.

The same applies to adjusting the spacing d between the two portions 301 and 309 of the binding which could be performed, more conventionally, by mounting the baseplates 302 and/or 310 in a supporting and position-holding slideway, as is commonly done for ski bindings.

What is claimed is:

1. An assembly for gliding on snow, the assembly comprising a snowboard and a system for receiving the boots of a user, the snowboard comprising in its longitudinal direction a back zone, a middle zone, and a front zone, and its structure comprising, from the bottom upwards:

a gliding surface made up of a glide soleplate between metal edges;

one or more bottom reinforcing layers;

a core;

one or more top reinforcing layers; and a protective and decoration-carrying sheet made either as a shell and thus constituting the top and the sides of the board, or else existing solely on the top surface of the board, in which case it rests on protective elements running along the sides of the core and referred to as flanks;

wherein:

the top face of the snowboard presents a substantial middle longitudinal depression which extends over at least the two zones in which the bindings for the feet are positioned, respectively for the front foot and for the back foot of the user, thereby defining on either side thereof two longitudinal lateral spars;

anchor points are provided in said two longitudinal lateral spars; and an intermediate device which is received in said anchor points serves to hold the user's feet to the board.

2. An assembly for gliding on snow according to claim 1, wherein the core of the snowboard is made up of a plurality of distinct portions comprising at least a right lateral portion and a left lateral portion each of which is sheathed by at least one layer of fibrous reinforcing material, each thus forming a longitudinal lateral spar, said spar having the structure of a box spar.

3. An assembly for gliding on snow according to claim 1, wherein said depression extends substantially over the entire load-carrying length of the board.

4. An assembly for gliding on snow according to claim 1, wherein said depression extends over said middle portion of the board.

5. An assembly for gliding on snow according to claim 1, wherein the depth of said depression varies along the length of the board depending on the position taken into consideration.

6. An assembly for gliding on snow according to claim 1, wherein the depth of said depression varies across the width of the board so that said depth is greater on one side than on the other.

7. An assembly for gliding on snow according to claim 5, wherein said depth is greater towards the front of the board.

8. An assembly for gliding on snow according to claim 1, wherein the depth of said depression is constant.

9. An assembly for gliding on snow according to claim 1, wherein the width of said depression varies along its length.

10. An assembly for gliding on snow according to claim 1, wherein the width of said depression is constant along its length.

11. An assembly for gliding on snow according to claim 1, wherein each of said lateral spars is substantially square in section.

12. An assembly for gliding on snow according to claim 1, wherein each of said lateral spars is essentially trapezoidal in section.

13. An assembly for gliding on snow according to claim 1, wherein each of said lateral spars is of a section that is rounded and substantially circularly arcuate.

14. An assembly for gliding on snow according to claim 1, wherein its snowboard has a central core portion in the form of a third bar positioned under said depression.

15. An assembly for gliding on snow according to claim 1, wherein its snowboard does not have a central core portion.

16. An assembly for gliding on snow according to claim 15, wherein its snowboard has a bottom reinforcing plate overlying the soleplate and constituted by a plate made of metal, typically aluminum alloy, situated between the flanges of the bottom lateral edges and substantially in line with said flanges.

17. An assembly for gliding on snow according to claim 1, the assembly including metal inserts in said right and left lateral core portions of the snowboard, said inserts providing anchor points for the boot-binding devices.

18. An assembly for gliding on snow according to claim 1, wherein its device for receiving bindings includes, between the top surface of the snowboard and the binding, an interface which is constituted by at least one rigid plate which comprises:

firstly towards the front and back margins which are to cover the right and left lateral portions of the snowboard in said binding-positioning zone, anchor means for anchoring said plate in said right and left lateral portions of the snowboard, said means for anchoring to the snowboard thus being located respectively at the front and at the back of the foot of the user; and secondly, in its central zone that is therefore designed to overlie the middle zone of the snowboard, binding receiving and anchoring means provided to coincide with the orifices that exist for this purpose in said binding, said binding anchoring means thus underlying the arch of the sole of the user's foot.

19. An assembly for gliding on snow according to claim 18, wherein said rigid plate is carried on the snowboard via a layer of material having damping characteristics.

20. An assembly for gliding on snow according to claim 18, wherein said plate is made of light metal.

21. An assembly for gliding on snow according to claim 18, wherein the means for anchoring said plate to the snowboard are constituted by longitudinal slots enabling the position of the plate to be adjusted longitudinally.

22. An assembly for gliding on snow according to claim 18, wherein the means for anchoring said plate to the snowboard are constituted by circulary-arcuate slots enabling the position of the plate to be adjusted angularly.

23. An assembly for gliding on snow according to claim 18, wherein said means for anchoring said plate are constituted, towards the toes, by transverse slots co-operating with sliding anchor screws to allow sliding which enables the snowboard to flex transversely.

24. An assembly for gliding on snow according to claim 18, the assembly having a single plate for receiving both the front binding and the back binding.

25. An assembly for gliding on snow according to claim 18, wherein the means for receiving the bindings in said plate include longitudinal slots placed in register with the depression of the snowboard, thereby allowing the positions of the bindings to be adjusted longitudinally.

26. An assembly for gliding on snow according to claim 18, wherein said second means are constituted by two zones, one for each binding, each having eight holes, the holes being spaced apart from one another by 40 millimeters and being distributed in two parallel columns each having four holes.

27. An assembly for gliding on snow according to claim 18, wherein said second means are constituted by two zones, one for each binding, each having three holes, the three holes being disposed in a triangular configuration.

28. An assembly for gliding on snow according to claim 1, wherein the device for binding the boots comprises at least, for each foot respectively: a distinct baseplate for receiving the sole of the boot, and wherein said plate for receiving the sole of the boot is fitted with at least two families of orifices or slots to enable said plate to be anchored on the snowboard:

at the back of the plate: at least one slot or series of at least two holes situated under the back of the boot that is to be received and thus under the heel of the user; and at the front the plate: a series of at least two elongate and rectilinear slots situated under the front of the boot to be received and thus under the front of the user's foot, each being oriented towards the central region of the plate, the slots being dimensioned so that in the event of the snowboard flexing, they allow front anchor members for anchoring said baseplate to the snowboard to slide freely therein.

29. An assembly for gliding on snow according to claim 28, in which said binding device has a series of securing holes at the back, the assembly being wherein each back hole coincides on a common respective diameter of a common circle with an associated front slot.

30. An assembly for gliding on snow according to claim 29, wherein each binding has a plurality of slots or series of holes, at the back which are offset from each other in the longitudinal direction of the baseplate.

31. An assembly for gliding on snow according to claim 28, wherein each binding has only two holes at the back and two slots at the front.

32. An assembly for gliding on snow according to claim 28, wherein a layer of viscoelastic material is fitted beneath said baseplate.

33. An assembly for gliding on snow according to claim 1, comprising, for each foot: a respective "soft" type binding suitable for receiving a flexible boot for snowboarding, said binding having lateral margins and a back margin that are raised so as to hold the flexible boot, and at least two straps for holding said flexible boot, comprising a back strap which is tightened over the instep and a front strap which is tightened over the front of the foot, wherein said binding has two distinct portions that are separate from each other, namely a front portion which is fixed to the snowboard on its front side and which receives said front strap, and a back portion that is thus independent of the front portion and that is fixed to the heel or back side of the snowboard, and which receives the back strap.

34. An assembly for gliding on snow according to claim 33, wherein the front portion of said binding has a rigid baseplate which is pierced by at least one slot or orifice for passing means for anchoring said portion to the snowboard, wherein the back portion of said binding comprises in the same manner at least one slot or orifice for passing means for binding said portion to the snowboard, and wherein these slots or orifices are disposed to coincide with anchoring locations provided on the snowboard at a distance from the longitudinal axis of the snowboard which is greater than a minimum half-width of the snowboard in the middle longitudinal zone of the snowboard.

35. An assembly for gliding on snow according to claim 34, wherein said distance is about two-thirds of said half-width.

36. An assembly for gliding on snow according to claim 34, wherein the or each of said slots is a circularly-arcuate slot with its concave side directed towards the sole of the foot.

37. An assembly for gliding on snow according to claim 34, wherein at least one of its tow portions has at least two circularly-arcuate slots so as to make it possible to vary the spacing between said two portions.

38. An assembly for gliding on snow according to claim 37, wherein the circularly-arcuate slots are concentric on the corresponding respective portion.

39. An assembly for gliding on snow according to claim 33, the assembly being fitted with means such as conventional inserts for receiving means for anchoring each binding portion, which means are positioned at a distance from its middle longitudinal axis which is greater than half the minimum half-width thereof in its middle longitudinal zone.

40. An assembly for gliding on snow according to claim 39, wherein said means for receiving anchor means are positioned in rows with each of said rows having a plurality of said means, each of said rows being parallel to the middle longitudinal axis of the snowboard.

* * * * *